US010950993B2

(12) United States Patent
Zhang et al.

(10) Patent No.: US 10,950,993 B2
(45) Date of Patent: Mar. 16, 2021

(54) COAXIAL CONNECTOR

(71) Applicant: CommScope Technologies LLC, Hickory, NC (US)

(72) Inventors: Yujun Zhang, Jiangsu (CN); Hongjuan An, Jiangsu (CN); Jin Liu, Jiangsu (CN); Jien Zheng, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 16/269,699

(22) Filed: Feb. 7, 2019

(65) Prior Publication Data

US 2019/0267762 A1 Aug. 29, 2019

(30) Foreign Application Priority Data

Feb. 24, 2018 (CN) ..... 201810156032.9

(51) Int. Cl.

| | |
|---|---|
| ***H01R 24/40*** | (2011.01) |
| ***H01R 13/11*** | (2006.01) |
| ***H01R 13/50*** | (2006.01) |
| *H01R 13/207* | (2006.01) |

(52) U.S. Cl.

CPC ..... *H01R 24/40* (2013.01); *H01R 13/111* (2013.01); *H01R 13/50* (2013.01); *H01R 13/207* (2013.01)

(58) Field of Classification Search

CPC ..... H01R 24/40; H01R 13/111; H01R 13/50; H01R 13/208

USPC ..... 439/607.04, 578–595, 599

See application file for complete search history.

(56) References Cited

U.S. PATENT DOCUMENTS 4,519,666 A * 5/1985 Williams ..... H01R 4/10 439/578
5,074,809 A * 12/1991 Rousseau ..... H01R 24/44 439/578
5,474,470 A * 12/1995 Hammond, Jr. ..... H01R 24/44 439/578
7,156,696 B1 1/2007 Montena (Continued)

OTHER PUBLICATIONS

International Search Report andWritten Opinion corresponding to International Application No. PCT/US2019/016570 dated May 21, 2019.

*Primary Examiner* — Harshad C Patel
(74) *Attorney, Agent, or Firm* — Myers Bigel, P.A.

(57) ABSTRACT

The present disclosure discloses a coaxial connector including a female connector and a male connector, which have free ends. The female connector includes: a first inner conductor; a first outer conductor; and a first insulator arranged between the first inner conductor and the first outer conductor. The male connector includes: a second inner conductor, a second outer conductor, and a second insulator for isolating and supporting the second inner conductor and the second outer conductor, arranged between the second inner conductor and the second outer conductor, wherein the first outer conductor includes an inner main body circumferentially surrounding the first insulator, the inner main body includes a resilient finger-shaped element located at the free end of the first outer conductor, and the first outer conductor and the second outer conductor form electrical contact by means of the resilient finger-shaped element, wherein the first insulator extends longitudinally at least as far as the resilient finger-shaped element.

11 Claims, 4 Drawing Sheets

(56) References Cited

U.S. PATENT DOCUMENTS

| | | | | |
|---|---|---|---|---|
| 7,736,194 | B1 | 6/2010 | Chang | |
| 8,888,519 | B2 * | 11/2014 | Baumler | H01R 31/06 439/248 |
| 8,888,527 | B2 * | 11/2014 | Chastain | H01R 24/542 439/578 |
| 9,893,466 | B2 * | 2/2018 | Wu | H01R 13/6275 |
| 9,966,702 | B2 | 5/2018 | Swearingen et al. | |
| 2007/0004276 | A1 * | 1/2007 | Stein | H01R 13/6271 439/578 |
| 2011/0256760 | A1 | 10/2011 | Igarashi et al. | |
| 2014/0248797 | A1 * | 9/2014 | Darrow | H01R 9/0524 439/583 |
| 2016/0006145 | A1 * | 1/2016 | Goebel | H01R 13/6581 439/345 |
| 2018/0026409 | A1 | 1/2018 | Kim | |

* cited by examiner

COAXIAL CONNECTOR

RELATED APPLICATION

The present application claims priority from and the benefit of Chinese Patent Application No. 201810156032.9, filed Feb. 24, 2018, the disclosure of which is hereby incorporated herein by reference in its entirety.

FIELD OF THE INVENTION

The present disclosure generally relates to the field of coaxial connectors. More specifically, the present disclosure relates to a coaxial connector for radio frequency transmission.

BACKGROUND OF THE INVENTION

A coaxial cable is commonly used in a radio frequency (RF) communication system. A coaxial connector is typically attached to an end of the cable, so that the cable can be connected to a device or other cable. It can be generally understood that a radio frequency coaxial connectors are port elements for connections between functional modules in a wireless communication device, between an antenna and a receiving and sending module, and between radio frequency coaxial cables. The functions and performance index requirements of the radio frequency coaxial connector are as follows: in addition to the connection and disconnection functions, the requirements of electrical properties, mechanical properties and environmental resistance in a connection state must also be satisfied. Specifically, in order for the radio frequency coaxial connector to effectively transmit radio frequency electromagnetic signals and energy, the characteristic impedance thereof should be matched with the characteristic impedance of the connected radio frequency system, and the reflection coefficient and insertion loss of the radio frequency coaxial connector need to be small. Meanwhile the radio frequency coaxial connector should have good radio frequency shielding efficiency and low intermodulation distortion.

The existing N type connector and SMA type connector realize electrical and mechanical connections by using the longitudinal contact of an outer conductor of a female connector and an outer conductor of a male connector. The existing connector interface using the longitudinal contact of the outer conductors has the disadvantages that the mechanical and electrical planes thereof are associated. Therefore, in order to achieve optimal electrical contact, a high degree of mechanical face-to-face contact must be achieved simultaneously between matching interface main bodies. If a sufficient contact pressure is not applied, passive intermodulation (PIM) distortion will result. In addition, a sealing ring is disposed between the mechanical contact surfaces, and thus a very large torque may be needed to compress the sealing ring.

In addition, air is generally used as an insulating medium between the inner conductor and the outer conductor of the existing female connector and male connector, so that both the inner conductor and the outer conductor are in a suspended state. Shaking and accidental damage are prone to occur in the case of vibration in the peripheral environment.

In view of the above problems, it is desirable to provide a connector with positive PIM performance capable of separating mechanical and electrical interfaces. The connector can provide good protection for the inner conductor and the outer conductor.

SUMMARY OF THE INVENTION

One objective of the present disclosure is to provide a coaxial connector that can overcome at least one shortcoming in the prior art.

According to one aspect of the present disclosure, a coaxial connector is provided, the coaxial connector including a female connector and a male connector, wherein each of the female connector and the male connector has a free end, the female connector and the male connector are cooperatively connected with each other by the free ends, the female connector includes: a first inner conductor provided with an elongated accommodation cavity defining a longitudinal axis; a first outer conductor; and a first insulator for isolating and supporting the first inner conductor and the first outer conductor, arranged between the first inner conductor and the first outer conductor, the male connector includes: a second inner conductor provided with an elongated insertion pin that can be inserted into the elongated accommodation cavity of the first inner conductor, a second outer conductor, and a second insulator for isolating and supporting the second inner conductor and the second outer conductor, arranged between the second inner conductor and the second outer conductor, wherein the first outer conductor includes a resilient finger-shaped element circumferentially surrounding the first insulator, the resilient finger-shaped element is formed at the free end of the first outer conductor, and the first outer conductor and the second outer conductor form radial contact by means of the resilient finger-shaped element, wherein the first insulator extends longitudinally at least as far as the resilient finger-shaped element.

BRIEF DESCRIPTION OF THE DRAWINGS

Aspects of the present disclosure will be better understood upon reading the following detailed description in conjunction with the drawings, in which.

DETAILED DESCRIPTION OF THE EMBODIMENTS

Figure 1:
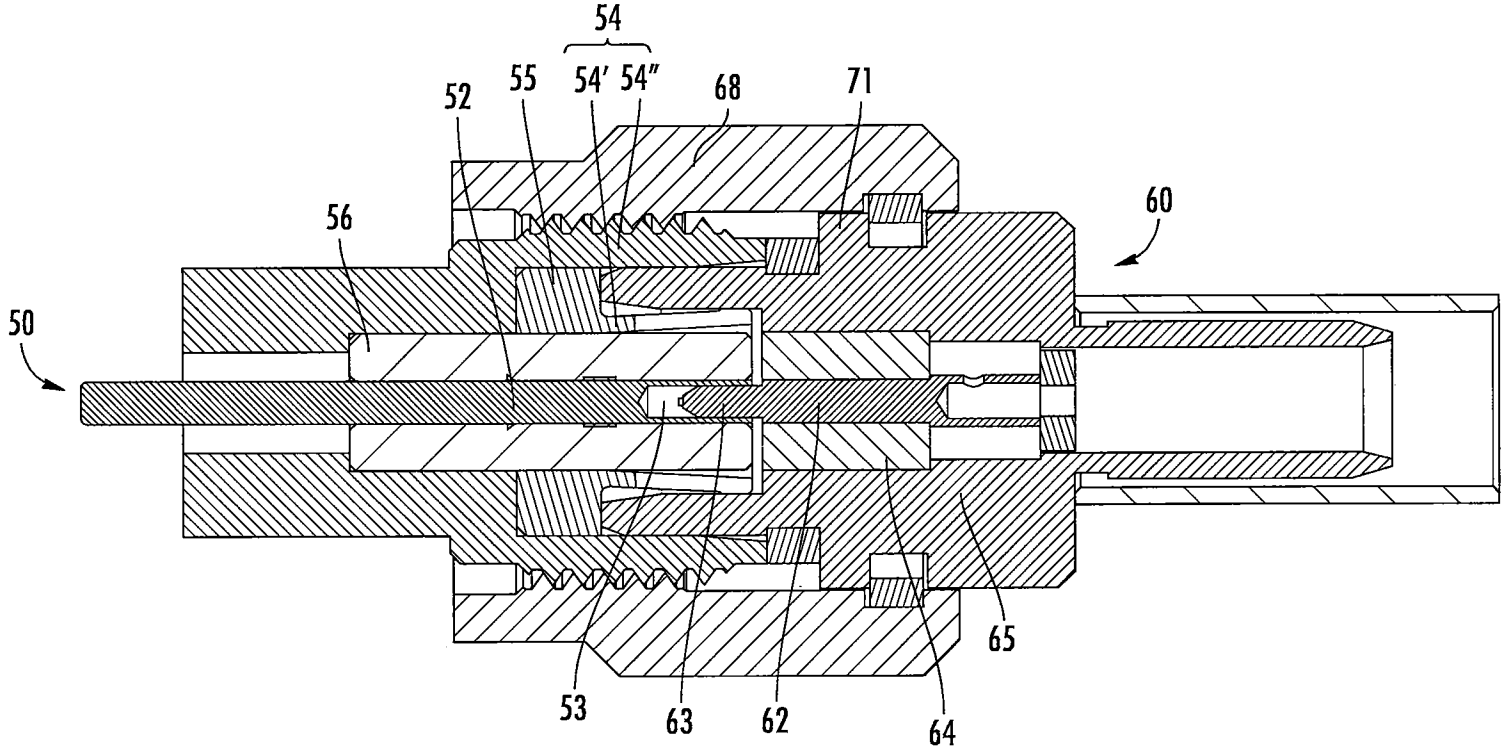
FIG. 1 shows a schematic section view of mutual connection of a female connector and a male connector of a 4.12-1.27 type connector according to the present disclosure.

The present disclosure will be described below with reference to the drawings, in which several embodiments of the present disclosure are shown. It should be understood, however, that the present disclosure may be embodied in various different manners and is not limited to the embodiments described below; in fact, the embodiments described below are intended to make the disclosure of the present disclosure be more complete and to fully illustrate the protection scope of the present disclosure to those skilled in the art. It should also be understood that the embodiments disclosed herein can be combined in various manners to provide more additional embodiments.

It should be understood that throughout the drawings, the same reference signs indicate the same elements. In the drawings, the sizes of some features may be modified for clarity.

It should be understood that the words used in the specification are for the purpose of describing particular embodiments only, and are not intended to limit the present disclosure. All terms used in the specification (including technical terms and scientific terms) have the meaning as commonly understood by those of ordinary skill in the art, unless otherwise defined. For the purpose of conciseness and/or clarity, well-known functions or structures may not be described in detail.

The singular forms "a", "said" and "the" used in the specification, unless otherwise indicated, include the plural forms. The terms "including," "comprising," and "containing" used in the specification indicate the existence of the claimed features, but do not exclude the presence of one or more other features. The word "and/or" used in the specification means including any and all combinations of one or more of the associated listed items. The words "between X and Y" and "between about X and Y" used in the specification should be construed as including X and Y. The word "between about X and Y" used in the specification means "between about X and about Y", and the word "from about X to Y" used in the specification means "from about X To about Y".

In the specification, when one element is described as being located "on" another element, "attached to" another element, "connected" to another element, "coupled" to another element, or "in contact with" another element, the element may be located directly located on the other element, attached to the other element, connected to the other element, coupled to the other element or in contact with the other element, or an intermediate element may be present. By contrast, when an element is described as being "directly" located "on" another element, "directly attached" to another element, "directly connected" to another element, "directly coupled" to another element, or "in direct contact with" another element, an intermediate element is not present. In the specification, that one feature is arranged to be "adjacent" another feature may mean that one feature has a part overlapping with the adjacent feature or a part located above or below the adjacent feature.

In the specification, the spatial relationship terms such as "up", "down", "left", "right", "front", "back", "high", "low" and the like may describe the relationship between one feature and another feature in the drawings. It should be understood that the spatial relationship terms, in addition to the orientations shown in the drawings, also include different orientations of the device in use or operation. For example, when the device in the figure is inverted, a feature previously described as "below" another features may be then described as being "above" the other feature. The device may also be oriented in other manners (rotated 90 degrees or at other orientations) in other manners, and at this time, the relative spatial relationship is explained correspondingly.

As described above, the present disclosure provides a coaxial connector interface (with a 4.12-1.27 type coaxial connector and a 3.04-10 type coaxial connector as an example) that is different from the traditional SMA type coaxial connector and the N type coaxial connector. The novel coaxial connector interface realizes an electrical connection by using the radial contact of an outer conductor, so that the mechanical contact is separated from electrical contact. Low PIM and high return loss performance can be provided independently from a mechanical coupling mechanism or the magnitude of an applied torque, and an inner conductor and the outer conductor are well supported by an insulator, thereby reducing the shake and the accidental damage of the inner conductor and the outer conductor. The 4.12-1.27 type coaxial connector and the 3.04-10 type coaxial connector provided herein are exemplary; the coaxial connector of the present disclosure may also be applied to connectors with other sizes, for example, a 3.5-1.27 type coaxial connector and a 2.92-1.27 type coaxial connector.

Figure 2:
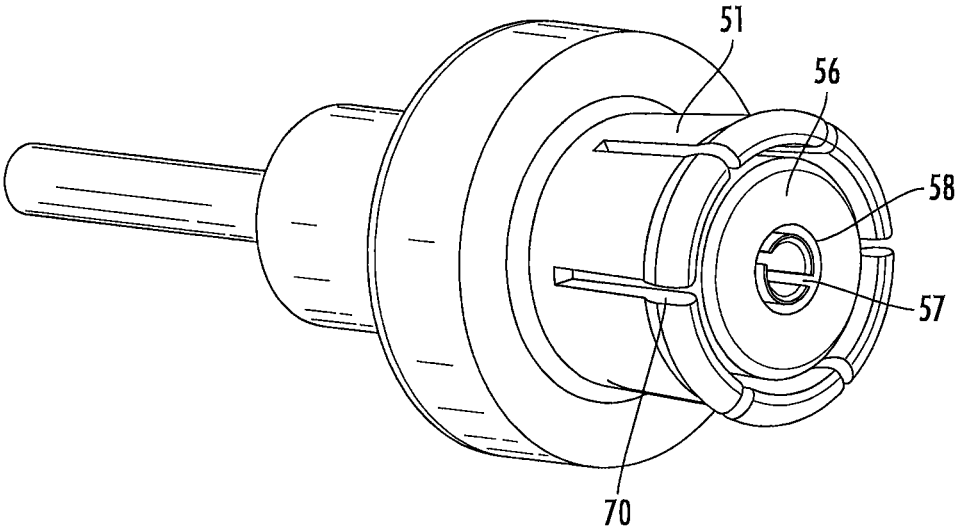
FIG. 2 shows a perspective view of an inner conductor, an outer conductor and an insulator of the female connector of the 4.12-1.27 type connector according to an embodiment the present disclosure.
Figure 3:
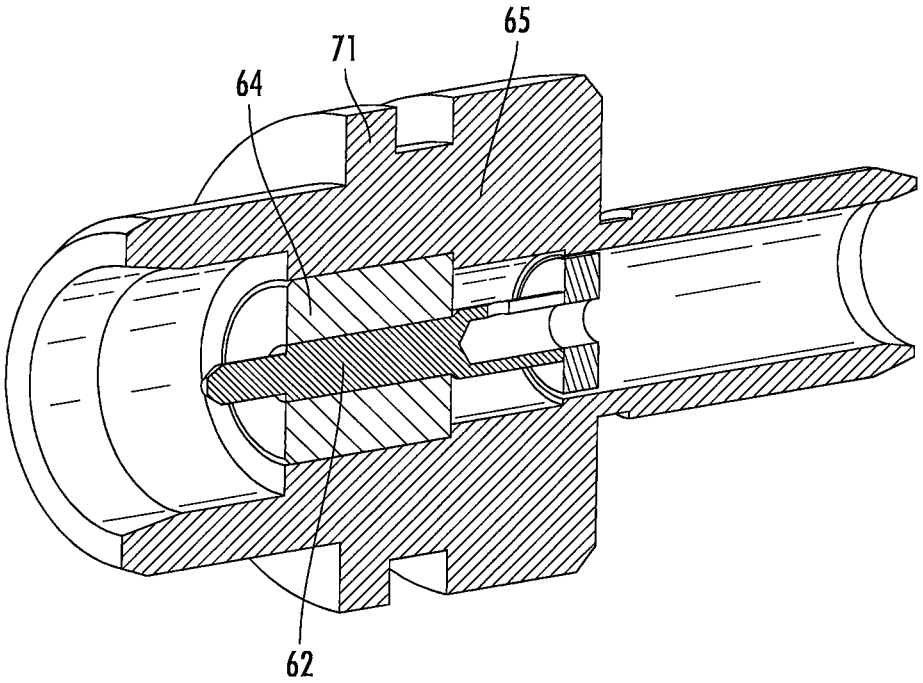
FIG. 3 shows a perspective section view of an inner conductor, an outer conductor and an insulator of the male connector of the 4.12-1.27 type connector according to an embodiment the present disclosure.

FIGS. 1 to 3 show the 4.12-1.27 type coaxial connector of the present disclosure. The coaxial connector includes a female connector 50 and a male connector 60. An inner conductor 62 and an outer conductor 65 of the male connector 60 are correspondingly inserted into an inner conductor 52 and an outer conductor 54 of the female connector 50 so as to realize the mutual electric connection between the male connector 60 and the female connector 50. The coaxial connector further includes a clamping nut 68, with the clamping nut 68 arranged on the male connector 60. The outer conductor 65 of the male connector 60 is provided with a shoulder 71 to serve as a stop for the clamping nut 68. The clamping nut 68 includes internal threads for matching with external threads of the female connection 50 to form a threaded clamping connection between the female connector 50 and the male connector 60.

Specifically, FIG. 1 shows a schematic section view of mutual connection of the female connector and the male connector of the 4.12-1.27 type connector according to the present disclosure. As shown in FIGS. 1 and 2, the female connector 50 includes an inner conductor 52, an insulator 56 and an outer conductor 54. The inner conductor 52 defines a longitudinal axis of the coaxial connector and is provided with an elongated accommodation cavity 53 for accommodating an insertion pin 63 of the male connector 60. The elongated accommodation cavity 53 is defined by a resilient finger-shaped element 58 (as shown in FIG. 2). The resilient finger-shaped element 58 is provided with a plurality of slots 57 (as shown in FIG. 2) extending along the longitudinal axis. The plurality of slots 57 are uniformly arranged along the circumferential direction of the resilient finger-shaped element; typically 3-8 slots 57 are formed, and preferably 8. The outer conductor 54 is provided with external threads for engaging the internal threads of the clamping nut 68. The insulator 56 is cylindrical and is arranged between the inner conductor 52 and the outer conductor 54 for isolating and supporting the inner conductor 52 and the outer conductor 54. As an example, the outer diameter of the inner conductor 52 is about 1.27 mm, and the inner diameter of the outer conductor 54 is about 4.12 mm.

As shown in FIGS. 1 and 3, the male connector 60 includes an inner conductor 62, an insulator 64, and an outer conductor 65. The inner conductor 62 defines the longitudinal axis of the coaxial connector. The inner conductor 62 includes a main body and an insertion pin 63 having a diameter smaller than the outer diameter of the main body of the inner conductor 62, and the insertion pin 63 can be inserted into the elongated accommodation cavity 53 of the inner conductor 52 of the female connector 50. The insertion end of the insertion pin 63 may be formed in a frustoconical shape so as to be inserted into the accommodation cavity. The insulator 64 is cylindrical and is arranged between the inner conductor 62 and the outer conductor 65 for isolating and supporting the inner conductor 62 and the outer conductor 65. The inner conductors and the outer conductors of the female connector 50 and the male connector 60 are made of a metallic material such as copper. The insulators of the female connector 50 and the male connector 60 are made of an insulating support material, preferably made of a non-air insulating medium, such as polytetrafluoroethylene (PTFE) or a polymer of 4-methylpentene-1 (TPX).

The outer conductor 54 of the female connector 50 may include an inner main body 54' circumferentially surrounding the insulator 56 and an outer main body 54" locally abutting against the inner main body 54'. The inner main body 54' includes a resilient finger-shaped element 51 (as shown in FIG. 2) located at the free end of the outer conductor 54. The outer conductor 54 of the female connector 50 forms radial contact with the outer conductor 65 of the male connector 60 via the resilient finger-shaped element 51. A flange 55 extending radially outward from the resilient finger-shaped element 51 is formed at one end of the inner main body 54' opposite to the free end so as to abut the outer main body 54" of the outer conductor 54 in the radial direction and the longitudinal direction, and a gap is formed between the outer main body 54" of the outer conductor 54 and the resilient finger-shaped element 51 of the outer conductor 54 to form a space for accommodating the outer conductor 65 of the male connector 60.

The resilient finger-shaped element 51 circumferentially surrounds the insulator 56 so that the insulator 56 provides good support and protection for the resilient finger-shaped element 51 in the case of vibration or movement to provide stable PIM performance. In the present disclosure, since the resilient finger-shaped element 58 of the inner conductor 52 and the resilient finger-shaped element 51 of the outer conductor 54 are supported by the insulator 56. As shown in FIG. 1, the insulator 56 extends longitudinally at least as far as the resilient finger-shaped element 51 so that the resilient fingers are prevented from inward deflection. An interface more robust than the traditional SMA interface is provided so as to provide good protection for the resilient finger-shaped elements in the case of greater vibration or accidents.

Specifically, the resilient finger-shaped element 51 includes a plurality of slots 70 (see FIG. 2) extending around the periphery of the resilient finger-shaped element 51 along the longitudinal axis, the plurality of slots 70 are uniformly arranged along the circumferential direction of the resilient finger-shaped element 51, typically 3-8 slots are formed, and preferably 8. Due to the arrangement of the slots 70, the resilient finger-shaped element 51 has good resilience, so that the resilient finger-shaped element 51 can generate elastic deformation upon connecting with the outer conductor 65 of the male connector 60, in order to generate a positive pressure at a contact position to form reliable contact, thereby ensuring the electrical continuity, and providing low and stable passive intermodulation performance. Specifically, the resilient finger-shaped element 51 can extend outward or deflect inward within a small range. When the insertion pin 63 is inserted into the accommodating cavity 53, the free end of the outer conductor 65 is inserted into the gap between the outer main body 54" of the outer conductor 54 and the resilient finger-shaped element 51 of the inner main body 54', and the gap and the size of the free end of the outer conductor 65 are adjusted in such a way that the insertion of the free end of the outer conductor 65 causes the inward radial bending of the resilient finger-shaped element 51, so that a radial outward pressure is generated on the inner surface of the free end of the outer conductor 65 to establish the electrical connection. The resilient finger-shaped element 51 engages the inner surface of the free end of the outer conductor 65 to realize the electrical connection and, thus effectively ensuring the low intermodulation performance.

Referring to FIG. 1, when the male connector 60 cooperates with the female connector 50, the free end of the outer conductor 65 of the male connector 60 longitudinally abuts the flange 55 of the inner main body 54' of the outer conductor 54 of the female connector 50 so as to form a mechanical reference plane.

By adoption of the mutual cooperative connection structure of the female connector 50 and the male connector 60 of the present disclosure, the resilient finger-shaped element 51 of the outer conductor 54 of the female connector 50 forms radial contact with the outer conductor 65, so that the mechanical reference plane is separated from the electrical reference plane, and a connector with low PIM and high insertion loss is provided. In addition, as both of the resilient finger-shaped element 58 of the inner conductor 52 and the resilient finger-shaped element 51 of the outer conductor 54 are supported by the insulator 56, shaking of the inner conductor 52 is reduced. The insulator 56 extends longitudinally at least as far as the resilient finger-shaped element 51 so that the resilient fingers are prevented from inward deflection. Thus, an interface design more robust than the traditional SMA interface is provided for providing good protection for the inner conductors and the outer conductors in the case of high vibration, and thus the operation efficiency may be achieved up to 30 GHz.

Figure 4:
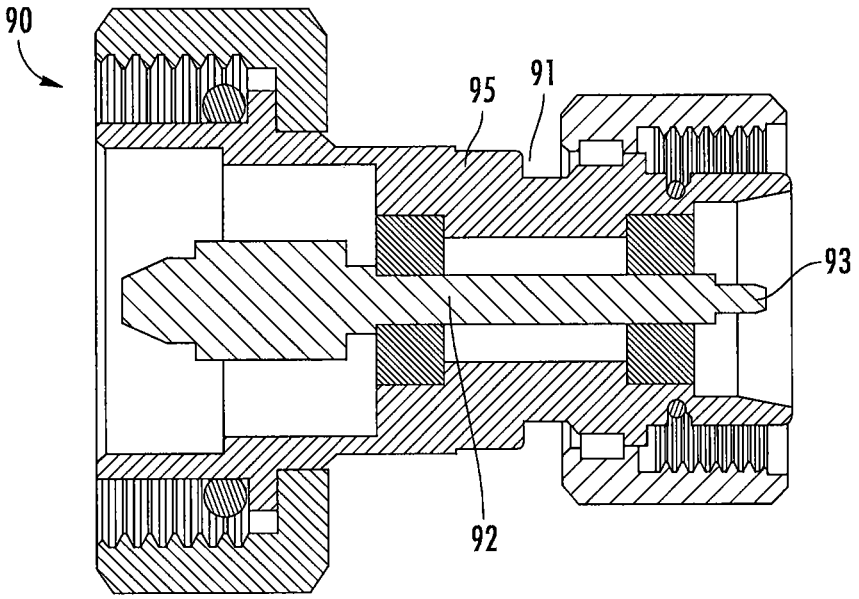
FIG. 4 shows a schematic section view of a male connector of a 3.04-10 type connector according to an embodiment of the present disclosure.
Figure 5:
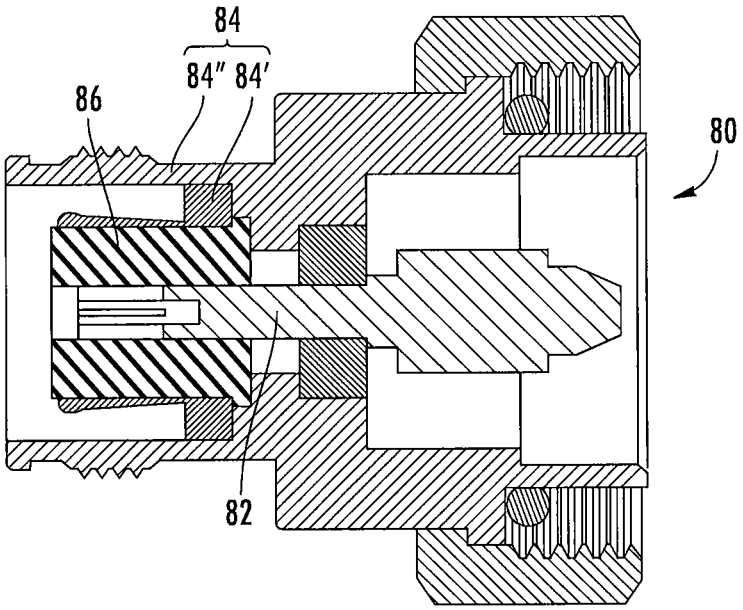
FIG. 5 shows a schematic section view of a female connector of the 3.04-10 type connector according to an embodiment of the present disclosure.

FIGS. 4 and 5 show section views of a male connector and a female connector of a 3.04-10 type connector according to another embodiment of the present disclosure. The 3.04-10 type connector as shown in FIGS. 4 and 5 has a similar structure with the 4.12-1.27 type connector, and only the structures different from the 4.12-1.27 type connector are described below. The positions of the mechanical reference planes of the female connector and the male connector of the 3.04-10 type connector are different from those of the mechanical reference planes of the female connector and the male connector of the 4.12-1.27 type connector. As shown in FIGS. 4 and 5, an outer conductor 84 of a female connector 80 includes an inner main body 84' and an outer main body 84", the free end of the outer main body 84" longitudinally abuts against a peripheral flange 96 of an outer conductor 95 of a male connector 90 to form the mechanical reference plane. The outer conductor 95 of the male connector 90 as shown in FIG. 4 is further provided with a sealing ring groove 91, a resilient sealing element is arranged in the sealing ring groove 91, and the sealing element is radially compressed inward when the female connector 80 is connected with the male connector 90, so that the male connector is firmly connected with the female connector, and thus effectively preventing radio frequency leakage and external electromagnetic interference. The sealing element is C-shaped or annular and is preferably made of conductive rubber. The outer diameter of the inner conductor of the female connector of the 3.04-10 type connector is about 3.04 mm, and the inner diameter of the outer conductor thereof is about 10 mm.

Figure 6:
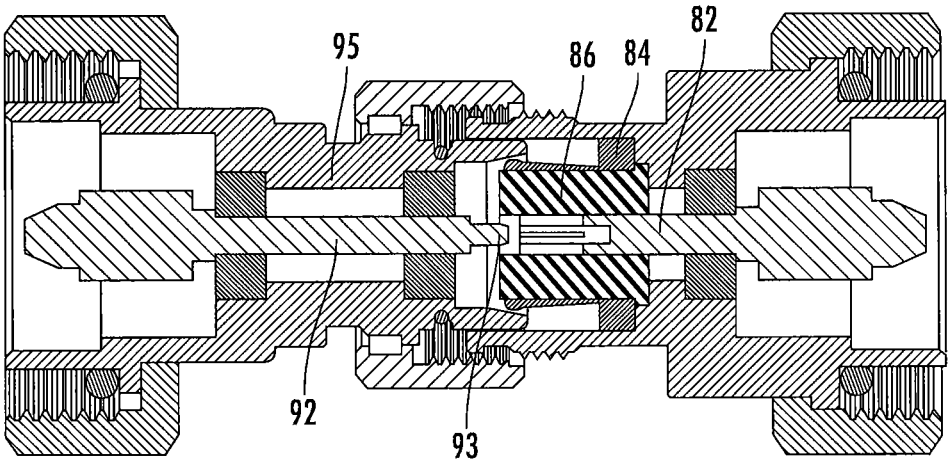
FIG. 6 shows a schematic section view of the male connector of FIG. 4 and the female connector of FIG. 5 during assembly according to the present disclosure.
Figure 7:
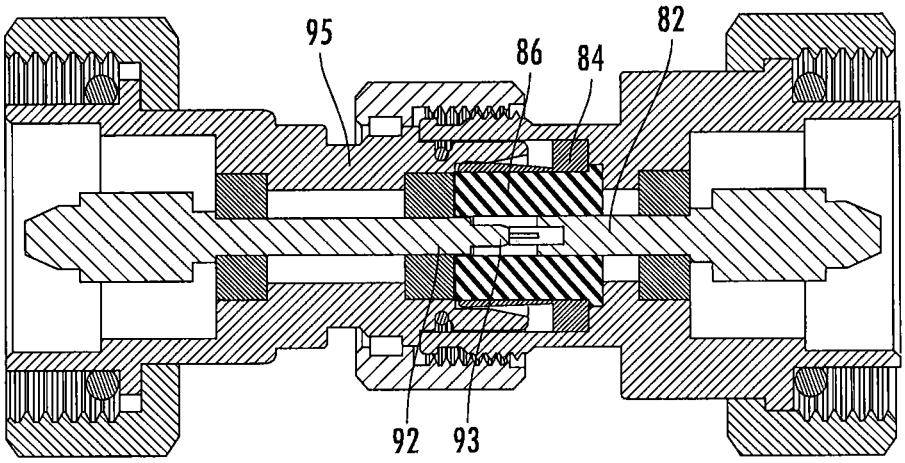
FIG. 7 shows a schematic section view when the female connector and the male connector shown in FIG. 6 are connected.

FIG. 6 shows a schematic section view during interconnection of the female connector and the male connector of the 3.04-10 type connector shown in FIGS. 4 and 5. FIG. 7 shows a schematic section view when the female connector and the male connector of the 3.04-10 type connector shown in FIGS. 4 and 5 are connected.

In the embodiment as shown in FIGS. 6 and 7, the free end of the inner conductor 82 of the female connector 80 recedes inward along the longitudinal direction for a distance relative to the flush end faces of the free ends of the insulator 86 and the resilient finger-shaped element of the outer conductor 84. The free end of an insertion pin 93 of the male connector 90 has a structure matched with the inner conductor 82 of the female connector 80, so that the outer conductor 84 of the female connector 80 and the outer conductor 95 of the male connector 90 can be partially inserted into each other in advance, so that the female connector 80 and the male connector 90 are coaxially aligned to each other. At this time, as the inner conductor 82 of the female connector 80 recedes inward, the inner conductor 92 of the male connector 90 and the inner conductor 82 of the female connector 80 are not in contact with each other, thereby avoiding the damage to the inner conductors 82, 92, and especially the inner conductor 82 of the female connector 80. Moreover, the air gap is as small as possible after the cooperation of the male connector 90 and the female connector 80 to achieve good electrical performance.

Although the exemplary embodiments of the present disclosure have been described, those skilled in the art should understand that they may make various changes and modifications to the exemplary embodiments of the present disclosure without departing from the spirit or scope of the present disclosure. Accordingly, all changes and modifications are included within the protection scope of the present disclosure as defined by the appended claims. The present disclosure is defined by the appended claims, and equivalents of these claims are also included therein.

The invention claimed is:

1. A coaxial connector, comprising a female connector and a male connector, wherein each of the female connector and the male connector has a free end, the female connector and the male connector are cooperatively connected with each other by the free ends, the female connector comprises:

a first inner conductor provided with an elongated accommodation cavity defining a longitudinal axis, wherein the elongated accommodation cavity is defined by a first resilient finger-shaped element;

a first outer conductor; and a first insulator for isolating and supporting the first inner conductor and the first outer conductor, arranged between the first inner conductor and the first outer conductor, the male connector comprises:

a second inner conductor provided with an elongated insertion pin that can be inserted into the elongated accommodation cavity of the first inner conductor, a second outer conductor, and a second insulator for isolating and supporting the second inner conductor and the second outer conductor, arranged between the second inner conductor and the second outer conductor, wherein the first outer conductor comprises an inner main body circumferentially surrounding the first insulator, the inner main body comprises a second resilient finger-shaped element located at the free end of the first outer conductor, and the first outer conductor and the second outer conductor form radial electrical contact by means of the second resilient finger-shaped element, wherein the first insulator extends longitudinally to the edge of the free end of the first inner conductor and the edge of the free end of the first outer conductor such that the first resilient finger-shaped element is surrounded by the first insulator.

2. The coaxial connector of claim 1, wherein the first outer conductor further comprises an outer main body, the inner main body is provided, on one end opposite to the free end, with a flange that radially extends outward from the second resilient finger-shaped element to radially abut the outer main body so as to form a gap for accommodating the second outer conductor between the outer main body and the second resilient finger-shaped element.

3. The coaxial connector of claim 1, wherein a free end of the first inner conductor deflects inward along the longitudinal direction relative to flush end faces of the second resilient finger-shaped element and the first insulator.

4. The coaxial connector of claim 1, wherein the first insulator and the second insulator are formed by a non-air insulating medium.

5. The coaxial connector of claim 4, wherein the first insulator and the second insulator are formed by a PTFE or TPX material.

6. The coaxial connector of claim 1, wherein an annular groove is formed in an outer circumferential surface of the second outer conductor to accommodate a radial-compression sealing ring fitting with the first outer conductor.

7. The coaxial connector of claim 1, wherein the outer diameter of the first inner conductor is about 1.27 mm, and the inner diameter of the inner main body of the first outer conductor is about 4.12 mm.

8. The coaxial connector of claim 1, wherein the outer diameter of the first inner conductor is about 3.04 mm, and the inner diameter of the inner main body of the first outer conductor is about 10 mm.

9. The coaxial connector of claim 6, wherein the resilient finger-shaped element of the inner main body and the resilient finger-shaped element of the first inner conductor are each provided with at least one slot extending along the longitudinal direction.

10. A coaxial connector, comprising a female connector and a male connector, wherein each of the female connector and the male connector has a free end, the female connector and the male connector are cooperatively connected with each other by the free ends, the female connector comprises:

a first inner conductor provided with an elongated accommodation cavity defining a longitudinal axis, wherein the elongated accommodation cavity is defined by a first resilient finger-shaped element;

a first outer conductor; and a first insulator for isolating and supporting the first inner conductor and the first outer conductor, arranged between the first inner conductor and the first outer conductor, the male connector comprises:

a second inner conductor provided with an elongated insertion pin that can be inserted into the elongated accommodation cavity of the first inner conductor, a second outer conductor, and a second insulator for isolating and supporting the second inner conductor and the second outer conductor, arranged between the second inner conductor and the second outer conductor, wherein the first outer conductor comprises an inner main body circumferentially surrounding the first insulator, the inner main body comprises a second resilient finger-shaped element located at the free end of the first outer conductor, and the first outer conductor and the second outer conductor form radial electrical contact by means of the second resilient finger-shaped element, wherein the first insulator extends longitudinally to the edge of the free end of the first outer conductor.

11. A coaxial connector, comprising a female connector and a male connector, wherein each of the female connector and the male connector has a free end, the female connector and the male connector are cooperatively connected with each other by the free ends, the female connector comprises:

a first inner conductor provided with an elongated accommodation cavity defining a longitudinal axis, wherein the elongated accommodation cavity is defined by a first resilient finger-shaped element;

a first outer conductor; and a first insulator for isolating and supporting the first inner conductor and the first outer conductor, arranged between the first inner conductor and the first outer conductor, the male connector comprises:

a second inner conductor provided with an elongated insertion pin that can be inserted into the elongated accommodation cavity of the first inner conductor, a second outer conductor, and a second insulator for isolating and supporting the second inner conductor and the second outer conductor, arranged between the second inner conductor and the second outer conductor, wherein the first outer conductor comprises an inner main body circumferentially surrounding the first insulator, the inner main body comprises a second resilient finger-shaped element located at the free end of the first outer conductor, and the first outer conductor and the second outer conductor form radial electrical contact by means of the second resilient finger-shaped element, wherein the first insulator extends longitudinally to the edge of the free end of the first inner conductor and the edge of the free end of the first outer conductor such that the first resilient finger-shaped element is surrounded by the first insulator, wherein the first outer conductor further comprises an outer main body, the inner main body is provided, on one end opposite to the free end, with a flange that radially extends outward from the second resilient finger-shaped element to radially abut the outer main body so as to form a gap for accommodating the second outer conductor between the outer main body and the second resilient finger-shaped element.

* * * * *